US005423124A

United States Patent [19]

Marrocco

[11] Patent Number: 5,423,124

[45] Date of Patent: Jun. 13, 1995

[54] ADAPTABLE NAIL CLIPPINGS CATCHER

[76] Inventor: James A. Marrocco, 18170 Gloria Ct., Los Gatos, Calif. 95030

[21] Appl. No.: 103,446

[22] Filed: Aug. 6, 1993

[51] Int. Cl.[6] ..... A45D 29/02

[52] U.S. Cl. ..... 30/28; 30/124; 29/525

[58] Field of Search ..... 30/28, 27, 124, 125; 132/75.5, 75; 29/525, 453

[56] References Cited

U.S. PATENT DOCUMENTS

| | | | |
|---|---|---|---|
| 3,154,850 | 12/1962 | Okuno | 30/28 |
| 3,180,025 | 7/1963 | Tsunemi | 30/28 |
| 3,188,737 | 6/1965 | Chase | 30/28 X |
| 4,117,591 | 10/1978 | Terry | 30/28 X |
| 4,219,929 | 9/1980 | Min | 30/28 |
| 4,550,496 | 11/1985 | Reinicke | 30/28 X |
| 4,574,475 | 3/1986 | Lee | 30/28 |
| 4,577,754 | 3/1986 | Jones | 30/28 X |
| 4,602,430 | 7/1986 | Allen, Jr. | 30/28 |
| 4,640,011 | 2/1987 | Gamble | 30/28 |
| 4,956,915 | 9/1990 | Anderson | 30/28 |
| 5,010,644 | 4/1991 | Goench | 30/28 |
| 5,074,041 | 12/1991 | Wagner | 30/28 |

*Primary Examiner*—Rinaldi I. Rada
*Attorney, Agent, or Firm*—Donald E. Schreiber

[57] ABSTRACT

A nail clippings catcher formed from a pre-cut sheet of material having a hole punched through it. This pre-cut sheet preferably extends for some distance on either side of the hole along a fold-line passing through the hole. Folding this pre-cut sheet of material along a fold-line juxtaposes a surface of the sheet with itself. The juxtaposed surface of the sheet is then fastened together while a pocket for receiving nail clippings is concurrently established within the folded sheet. The nail clippings catcher is inserted between the jaws of a conventional nail clipper with the fold-line disposed adjacent to the jaws' cutting edges with the aperture formed through the sheet providing a channel through the folded sheet for the nail clipper's rivet, and an opening for nail clippings to enter and exit the pocket.

14 Claims, 3 Drawing Sheets

ADAPTABLE NAIL CLIPPINGS CATCHER

BACKGROUND OF THE INVENTION

1. Field of the Invention

The present invention relates generally to nail clippers such as finger nail clippers and toe nail clippers and, more particularly, to the type of nail clippers in which like elongated jaws are secured to each other at one end and diverge from each other in the direction of their opposite ends at which are located actuable cutting edges.

2. Description of the Prior Art

A well known type of finger nail and toe nail clipper such as that depicted and described in U.S. Pat. No. 2,477,782 entitled "Nail Clipper," that on Feb. 67, 1947 issued on a patent application filed in the name of William E. Bassett, includes a pair of similarly-shaped elongated upper and lower jaws that are secured to each other at one end. The upper and lower jaws diverge away from each other along their length extending away from the end at which they are fastened together. Each of the jaws includes matable cutting edges formed at the ends of the jaws furthest from their juncture. An open space between the diverging jaws permits nail clippings to escape from either side of the nail clipper.

This conventional type of nail clipper also includes a cylindrically-shaped rivet having a longitudinal axis that extends through apertures piercing each of the jaws adjacent to their opposed cutting edges. An enlarged head, formed at one end of the rivet, engages an outer surface of the lower jaw furthest from the upper jaw. The opposite end of the rivet projecting away from its head extends outward beyond the upper jaw. A notch formed in the length of the rivet that projects outward beyond the upper jaw receives one end of an elongated, angled lever.

If the lever is properly disposed with respect to the rivet and to the upper jaw, the lever's end furthest from the rivet is spaced a short distance apart from the upper jaw's outer surface. Disposing the lever in this position opens the opposed cutting edges to permit insertion of an item to be cut, such as a finger nail or a toe nail, between them. A force then applied to the end of the lever furthest from the rivet that urges the lever's end toward the upper jaw pulls the rivet through the upper jaw. Pulling the rivet through the upper jaw draws the enlarged head of the rivet together with the lower jaw toward the upper jaw. Drawing the two jaws together in this way closes and mates the opposed cutting edges together for severing whatever may be located therebetween. This conventional type of nail clipper is widely available in various different sizes adapted for cutting finger nails and toe nails of different sizes.

U.S. Pat. No. 3,154,850 entitled "Nail Clipper With Receiver For Clippings" that issued on a patent application filed in the name of Tsutomu Okuno ("the Okuno Patent") discloses a one-piece, U-shaped receptacle for nail clippings that fits within the open space between the jaws of a conventional nail clipper of the type described above. Opposing arms of the U-shaped receptacle disclosed in the Okuno Patent extend respectively along the length of each of the jaws between their cutting edges and the ends at which the jaws join together. Apertures formed through the opposing arms snap around the nail clipper's rivet. A hinge joining the arms together immediately adjacent to the ends at which the jaws join together completes the U-shaped receptacle's outer surface.

The U-shaped receptacle disclosed in the Okuno Patent includes flanges formed along the sides of the arms that respectively extend outward from one arm's edge toward the opposing arm's edge. The edges of the arms and the locations of the flanges along them are arranged so the flanges nest together when the arms close toward each other. Nested together in this way the flanges occlude the open sides of the nail clipper's jaws to capture and retain nail clippings within the receptacle. A dimple projecting outward from the outer surface of one of the receptacle's arms near the receptacle's hinge mates with a cavity formed in one of the nail clipper's jaws to lock the receptacle to the jaw for inhibiting its rotation about the rivet.

After a nail clipper which includes the clippings catcher disclosed in the Okuno Patent has been used, the receptacle is removed from the clipper for disposal of the clippings, and then reinserted to its position between the jaws to prepare the clipper for subsequent use. Because the receptacle disclosed in the Okuno Patent is adapted to fit within the open space between the jaws of the nail clipper and to be held there by the mating dimple and cavity, both the nail clipper and the receptacle disclosed in the Okuno Patent must be specially manufactured for use with each other.

U.S. Pat. No. 3,180,025 entitled "Combined Nail Clipper and Clippings Receptacle" that issued on a patent application filed in the name of Yasuhiko Tsunemi ("the Tsunemi Patent") discloses an envelope which encloses the jaws of a conventional nail clipper of the type described above except for their ends immediately adjacent to the cutting edges. The envelope includes an upper casing that is fixed to a nail clipper's upper jaw, and a lower casing that includes a latch for securing the lower casing to the nail clipper's lower jaw.

Each of the casings disclosed in the Tsunemi Patent includes a set of cylindrical hinge sleeves formed along its edge adjacent to the juncture of the nail clipper's jaws. The sleeves along each casing's edge mate with each other. Thus a pin inserted through the mated sleeves establishes a hinge joining the upper casing to the lower casing. Opposite ends of the pin are bent in opposite directions and respectively bear against the upper and lower casings to form a spring that urges the casings to close toward each other.

Juxtaposing the upper and lower casings respectively with a nail clipper's upper and lower jaws closes the envelope about the jaws. The envelope established by the closed upper and lower casings catch nail clippings as they are severed. Freeing the latch securing the lower casing to the lower jaw permits pulling the lower casing away from a nail clipper's lower jaw to discharge accumulated clippings. Because the envelope disclosed in the Tsunemi Patent encloses most of the nail clipper's jaws extending along most of their length from the jaws' juncture to their cutting edges, and because a latch secures the lower casing to the nail clipper's lower jaw; various different sizes of envelopes must be manufactured respectively for use with different sizes of nail clippers.

U.S. Pat. No. 4,640,011 entitled "Nail Clipper," which issued on a patent application filed in the name of William L. Gamble, ("the Gamble Patent") discloses an elongated, pan-shaped, one-piece clippings retainer, a mounting end of which snaps onto the bottom jaw of a conventional nail clipper of the type described above about the end of the clippers at which the jaws join together. A hinge, formed integrally into the middle of the clippings retainer, connects this mounting end of the retainer to a second actuable end of the clippings retainer. The actuable end of the clippings retainer extends from the hinge along the length of the lower jaw to its cutting edge, and includes side panels which effectively occlude the opening between the jaws on both sides of the nail clipper. Inner surfaces of the side panels of the clippings retainer include at its actuable end include detent formations that retain it on the nail clipper's lower jaw. Thus disposed on a nail clipper, the clippings retainer of the Gamble Patent effectively encloses all outer surfaces of the nail clipper's lower jaw except its cutting edge, and outer side surfaces of its upper jaw.

After the nail clipper has been used for severing nails, pulling the clippings retainer's actuable end away from the lower jaw opens the sides of the open space between the jaws to release any accumulated clippings. Because the clippings retainer disclosed in the Gamble Patent clips onto the nail clipper's lower jaw and extends along its entire length, various different sizes of this clippings retainer must be manufactured, each different size of which fits only a particular size of nail clipper.

SUMMARY OF THE INVENTION

The present invention provides an improved nail clippings catcher that, in a preferred embodiment, may be inserted into the open space between the jaws of a conventional nail clipper An object of the present invention is to provide a nail clippings catcher that may be fabricated with various aesthetically pleasing outlines.

Another object of the present invention is to provide a nail clippings catcher that may be readily adapted for use with one of various different sized of conventional nail clippers.

Another object of the present invention is to provide a nail clippings catcher that may be readily added to an existing nail clipper.

Another object of the present invention is to provide a nail clippings catcher which provides surfaces that may be decorated and/or present a message.

Another object of the present invention is to provide a nail clippings catcher that facilitates finding a nail clipper if it has been stored perhaps in a drawer or in a purse.

Another object of the present invention is to provide a nail clippings catcher that occupies a small space prior to formation of the nail clippings catcher.

Yet another object of the present invention is to provide a nail clippings catcher that is easily fabricated.

Another object of the present invention is to provide a nail clippings catcher that is economical to manufacture.

Another object of the present invention is to provide a nail clippings catcher that is economical enough to be disposable together with nail clippings retained in the catcher's pocket.

Briefly, the nail clippings catcher of the present invention is assembled from a pre-cut sheet of material that has had a hole punched through it. This pre-cut sheet preferably extends for some distance on either side of the hole along a fold-line that passes through the hole. Folding this pre-cut sheet of material along the fold-line juxtaposes a surface of the sheet with itself. The juxtaposed surface of the sheet is then fastened together while a pocket for receiving nail clippings is concurrently established within the folded sheet. Fastening the surfaces of the folded sheet together completes formation of the nail clippings catcher thus readying it for insertion between a jaws of a conventional nail clipper of the type described previously.

The nail clippings catcher is inserted between the jaws of a conventional nail clipper with the fold-line disposed adjacent to the jaws' cutting edges. Disposed in this position, the folded sheet of material extends away from the fold-line and the cutting edges between the jaws toward the ends of the jaws at which they join together, and the aperture formed through the sheet provides a channel through the folded sheet for the nail clipper's rivet, and an opening for nail clippings to enter and exit the pocket. In a preferred embodiment of the nail clippings catcher, the folded sheet of material also extends a significant distance outward from both sides of the open space between the nail clipper's jaws along the sheet's fold-line thus providing surfaces which may be decorated and/or have a message fixed thereon. Trimming the folded sheet of material extending away from the rivet of the nail clipper toward the ends of the jaws at which they join together prior to inserting the nail clippings catcher between the jaws adapts it for use with one of various different sizes of nail clippers.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

Figure 1:
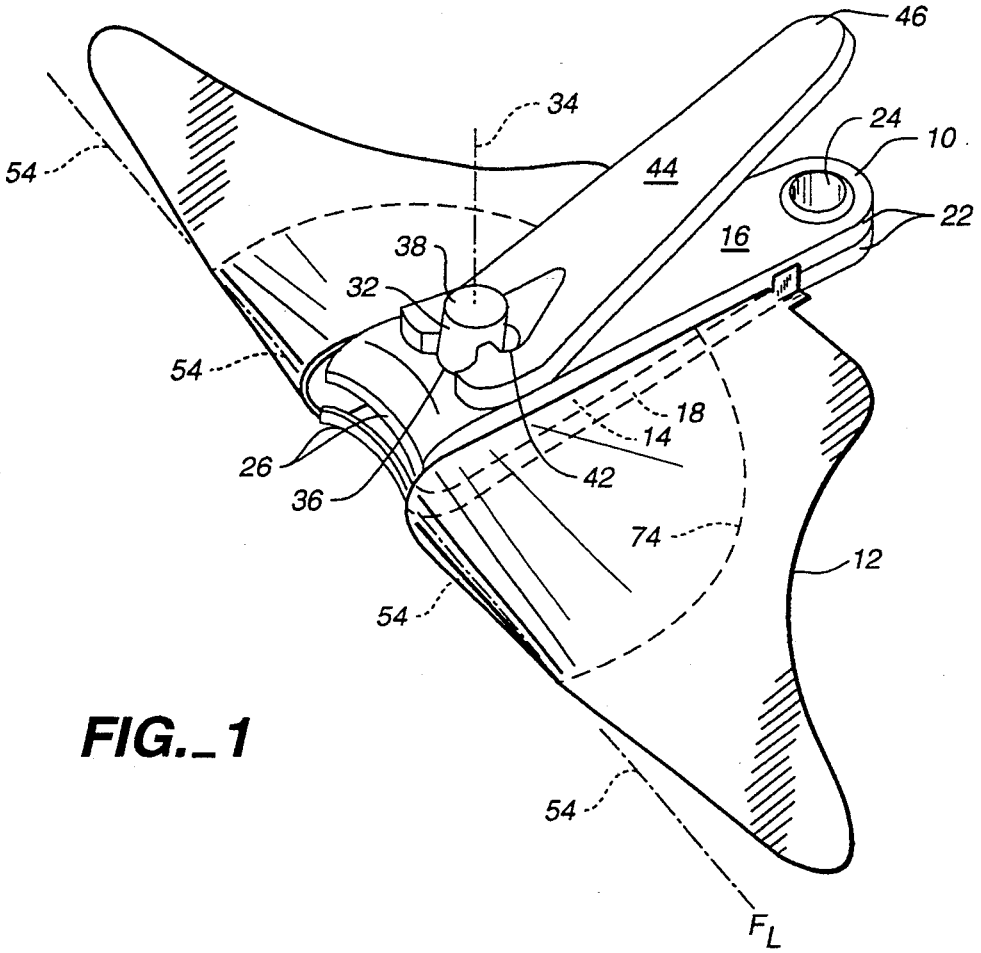
FIG. 1 is an overall perspective view illustrating a nail clipper having a nail clippings catcher in accordance with the present invention inserted between the nail clippers elongated jaws which depicts with a dashed circular arc the outer edge of the pocket for catching nail clippings established by folding a pre-cut sheet of material.

FIG. 1 is an overall perspective view illustrating a conventional nail clipper 10 having a nail clippings catcher 12 in accordance with the present invention inserted into an open space 14 between an upper jaw 16 and a lower jaw 18 of the nail clipper 10. The jaws 16 and 18 are similarly-shaped and are secured to each other at first ends 22 by an eyelet 24. The jaws 16 and 18 diverge away from each other along their length extending away from the first ends 22 at which they are fastened together. Each of the jaws 16 and 18 includes matable cutting edges 26 formed at the ends of the jaws 16 and 18 furthest from their juncture at the eyelet 24. Without the nail clippings catcher 12 inserted between the jaws 16 and 18, the open space 14 between the diverging jaws 16 and 18 permits nail clippings to escape from either side of the nail clipper 10.

This conventional type of nail clipper 10 also includes a cylindrically-shaped rivet 32 having a longitudinal axis 34 that extends through apertures 36 (only one of which is illustrated in FIG. 1) piercing each of the jaws 16 and 18 adjacent to their opposed cutting edges 26. An enlarged head (not illustrated in FIG. 1), formed at one end of the rivet 32, engages an outer surface of the lower jaw 18 furthest from the upper jaw 16. An opposite end 38 of the rivet 32 projecting away from its head extends upward above the upper jaw 16. A notch 42 formed in the length of the rivet 32 that projects upward above the upper jaw 16 receives one end of an elongated, angled lever 44.

If the lever 44 is properly disposed with respect to the rivet 32 and to the upper jaw 16 as illustrated in FIG. 1, an end 46 of the lever 44 furthest from the rivet 32 is spaced a short distance apart from an outer surface of the upper jaw 16. Disposing the lever in this position opens the opposed cutting edges 26 to permit insertion of an item to be cut, such as a finger nail or a toe nail, between the cutting edges 26. A force then applied to the end 46 of the lever 44 furthest from the rivet 32 that urges the end 46 toward the upper jaw 16 pulls the rivet 32 through the upper jaw 16. Pulling the rivet 32 through the upper jaw 16 draws the enlarged head of the rivet together with the lower jaw 18 toward the upper jaw 16. Drawing the two jaws 16 and 18 together in this way closes and mates the opposed cutting edges 26 together for severing whatever may be located therebetween. This conventional type of nail clipper 10 is widely available in various different sizes adapted for cutting finger nails and toe nails of different sizes.

Figure 2:
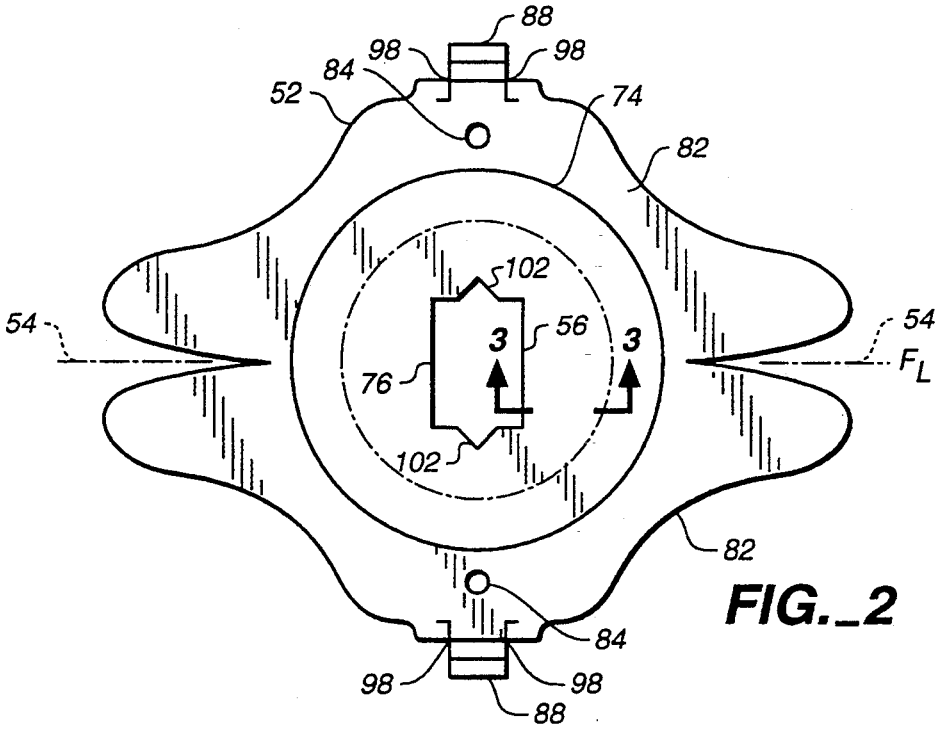
FIG. 2 is a plan view of a pre-cut sheet adapted for being folded into the nail clippings catcher depicted in FIG. 1 which illustrates a stiffening disk with phantom lines.
Figure 4A:
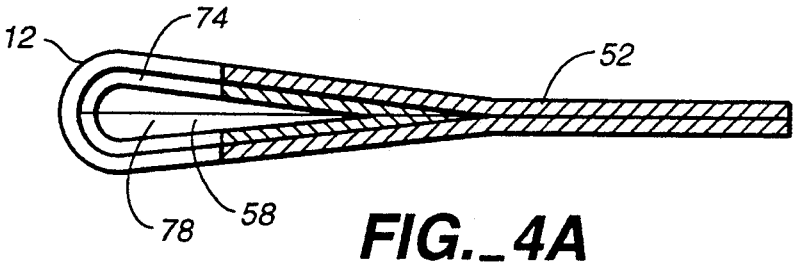
FIG. 4A is a cross-sectional view of the nail clippings catcher taken along the line 4A–4A of FIG. 4 which shows the interior of the pocket for catching nail clippings.

FIG. 2 is a plan view of a sheet 52 adapted for being folded along a fold-line 54 to form the nail clippings catcher 12. The particular sheet 52 illustrated in FIG. 2 is pre-cut so that upon being folded into the nail clippings catcher 12 it forms a shape resembling that of a butterfly. Upon folding the sheet 52 along the fold-line 54, a star-shaped aperture 56 punched through the sheet 52 at a location in which the fold-line 54 passes through the aperture 56 provides a channel 58, depicted in FIGS. 4, 4A and 6, through the folded sheet 52 for the rivet 32.

Figure 3:
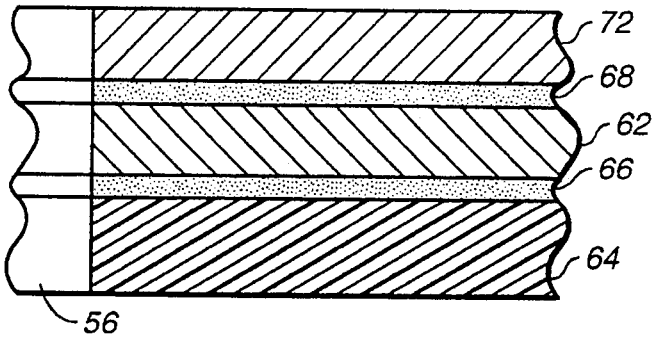
FIGS. 3 and 3A are cross-sectional views taken along the line 3—3 of FIG. 2 depicting various layers of material included in the preferred embodiment of the pre-cut sheet depicted in FIG. 2.
Figure 3A:
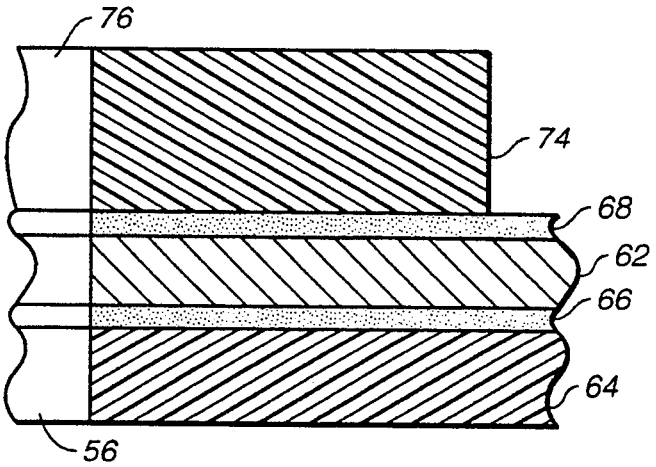

FIGS. 3 and 3A, cross-sectional views taken along the line 3—3 of FIG. 2, illustrates various layers of material included in the preferred embodiment of the pre-cut sheet 52 depicted in FIG. 2. The sheet 52 preferably includes a layer 62 of paper which is bonded to a 0.002 inch thick layer 64 of polyester material by a first layer 66 of adhesive. A decoration, e.g., a pattern appearing on the wings of a butterfly, or a text message, e.g., an advertisement, may be fixed on the surface of the layer 62 adjacent to the layer 64 before the layers 62 and 64 are joined together. A second layer 68 of adhesive, coated on a surface of the paper layer 62 opposite to that on which the layer 64 is bonded, secures a layer 72 of paper liner material to the layer 62 of paper.

Before the sheet 52 is folded to form the nail clippings catcher 12, the layer 72 of paper liner material is removed to expose the layer 68 of adhesive. After the layer 68 has been exposed, as depicted in FIG. 3A a 1.4 inch diameter, 0.005 inch thick, stiffening disk 74 of polyester or other springy material, through which an aperture 76 shaped identically to that of the aperture 56 has been formed, is secured to the layer 68 with the apertures 56 and 76 aligned. After the disk 74 has been secured to the layer 68, the sheet 52 together with the disk 74 is folded along the fold-line 54 to juxtapose with itself the layer 68 located on opposite sides of the fold-line 54. Juxtaposing the adhesive layer 68 together, fastens the sheet 52 to itself to form the nail clippings catcher 12 depicted in FIGS. 4 and 5. Upon folding both the sheet 52 and the disk 74 along the fold-line 54, the sheet 52 and the disk 74 establish a pocket 78 within the sheet 52, illustrated in FIGS. 4A and 5, that is adapted for receiving nail clippings through the aperture 56 after the nail clippings catcher 12 has been inserted into the open space 14 between the jaws 16 and 18.

As illustrated in FIG. 2, the sheet 52 of material is pre-cut symmetrically with respect to the fold-line 54 so edges 82 of the sheet 52 juxtapose with each other upon folding sheet 52 along the fold-line 54. During forming of the nail clippings catcher 12, two registration holes 84, punched through the sheet 52 symmetrically with respect to the fold-line 54, mate with a folding fixture (not illustrated in any of the FIGS.) to ensure that the sheet 52 folds along the fold-line 54 and that the edges 82 of the formed nail clippings catcher 12 juxtapose with each other.

The pre-cut sheet 52 includes tabs 88 which in FIG. 2 project symmetrically outward along the edges 82 of the sheet 52 furthest from the aperture 56. After the sheet 52 has been formed into the nail clippings catcher 12 depicted in FIG. 4, the tabs 88, now bonded together into a single tab by the adhesive of layer 68, may be trimmed to one of various different lengths whereby the nail clippings catcher 12 may be readily adapted for use with one of various different sizes of nail clipper 10. Trimming the tabs 88 adapts the nail clippings catcher 12 for use with a particular size of nail clipper 10.

The edges 82 of the sheet 52 are preferable pre-cut so that after folding the sheet 52 along the fold-line 54 the edges 82 do not extend beyond a circular arc 92 having a radius r lying in a plane that includes the fold-line 54 and that has a center 94 which lies within the aperture 56. The circular arc 92 extends through an angle $\alpha$ preferably on both sides of a reference line 96 that is disposed normal to the fold-line 54 and that passes through the center 94. The reference line 96 extends from the aperture 56 toward the edges 82 of the sheet 52 furthest from the aperture 56. The angle $\alpha$ is preferably no greater than sixty (60) degrees. To avoid removal of the rivet 32 from the nail clipper 10 in installing the nail clippings catcher 12, the radius r must be less than the distance from the longitudinal axis 34 of the rivet 32 to the juncture of the jaws 16 and 18 adjacent to their first ends 22 for the smallest nail clipper 10 with which the nail clippings catcher 12 may be used. Furthermore, to avoid removal of the rivet 32 in installing the nail clippings catcher 12, a line 97 which extends between the juncture of the apertures 56 and 76 with the fold-line 54 and the edges 82 of the sheet 52 must have a length 1 less than the distance from the longitudinal axis 34 of the rivet 32 to the juncture of the jaws 16 and 18 adjacent to their first ends 22 for the smallest nail clipper 10 with which the nail clippings catcher 12 may be used.

Figure 4:
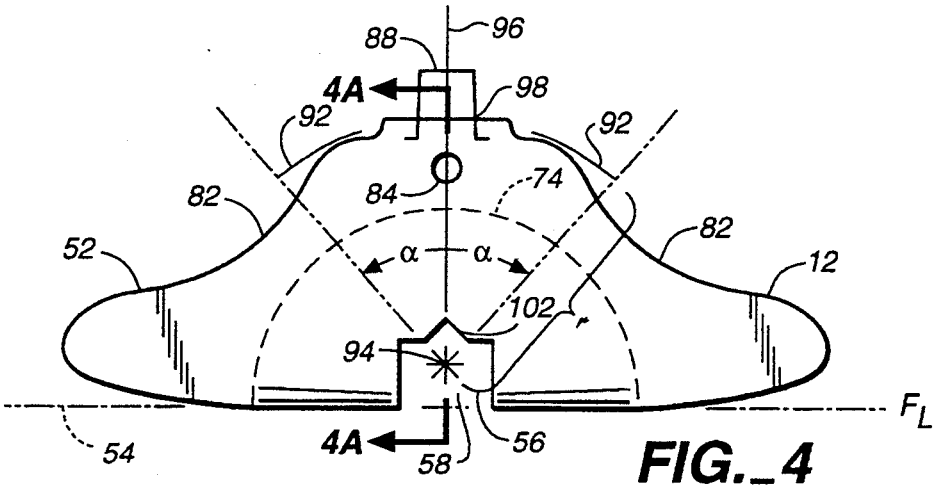
FIG. 4 is a top plan view of the pre-cut sheet of FIG. 2 after being folded to form the nail clippings catcher illustrated in FIG. 1.
Figure 5:
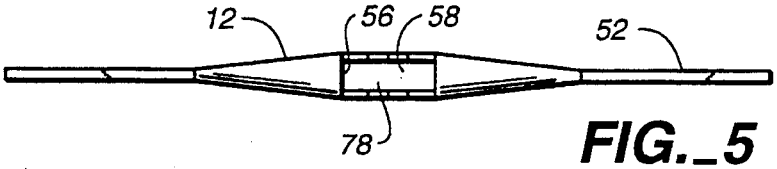
FIG. 5 is a front elevational view of the pre-cut sheet of FIG. 2 after being folded to form the nail clippings catcher depicted in FIG. 1.
Figure 6:
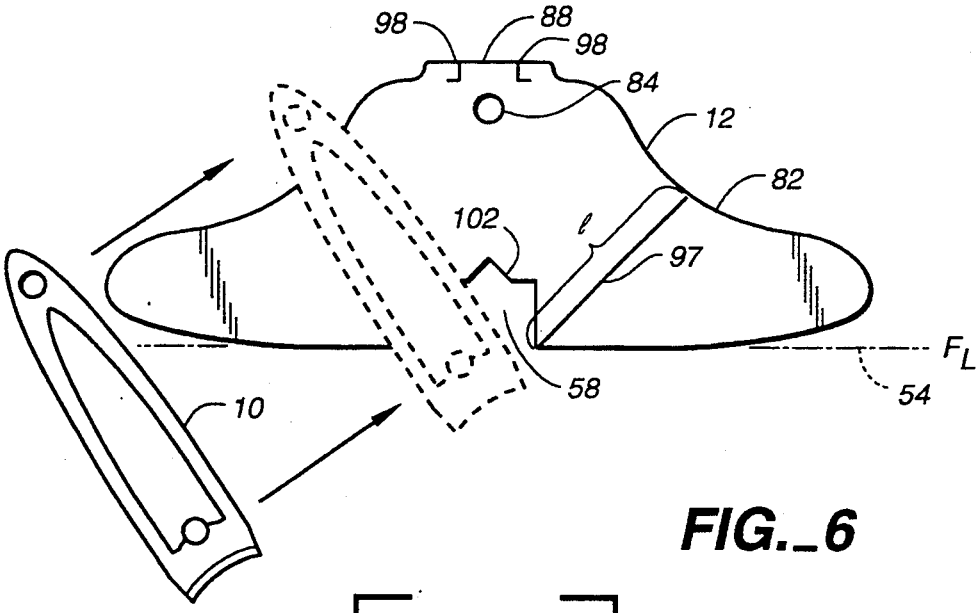
FIGS. 6 and 7 are plan views illustrating a procedure by which the nail clippings catcher depicted in FIG. 4 may be inserted into the space between the jaws of a nail clipper without disassembling the nail clipper.
Figure 7:
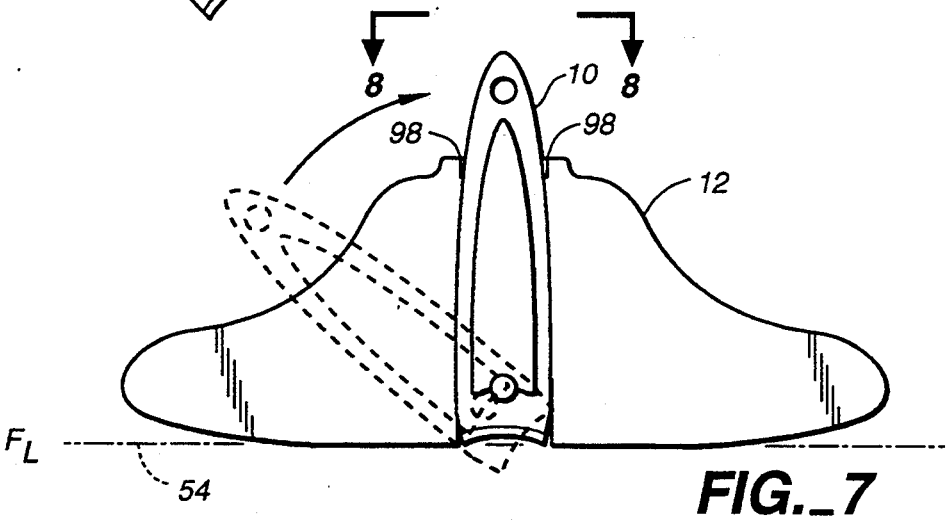

The formed nail clippings catcher 12 depicted in FIG. 4 may be inserted into the open space 14 between the jaws 16 and 18 of the nail clipper 10 as depicted in FIGS. 6 and 7 by first sliding the nail clipper 10 obliquely onto the nail clippings catcher 12 with the jaws 16 and 18 disposed respectively on opposite sides of the nail clippings catcher 12 until the channel 58 formed through the folded sheet 52 by the aperture 56 engages the rivet 32. After the channel 58 engages the rivet 32, the nail clipper 10 is then rotated about the rivet 32 until the tabs 88 are disposed between the jaws 16 and 18 as depicted in FIG. 7. Rotating the nail clippings catcher 12 about the rivet 32 of the nail clipper 10 until the tabs 88 are disposed between the jaws 16 and 18 disposes the fold-line 54 symmetrically with respect to the cutting edges 26 of the jaws 16 and 18. The nail clippings catcher 12 may be removed from the nail clipper 10 by reversing the preceding procedure. Thus, the nail clippings catcher 12 may be inserted into or removed from the open space 14 between the jaws 16 and 18 of the nail clipper 10 without loosening the rivet 32 from the jaws 16 and 18.

Figure 8:
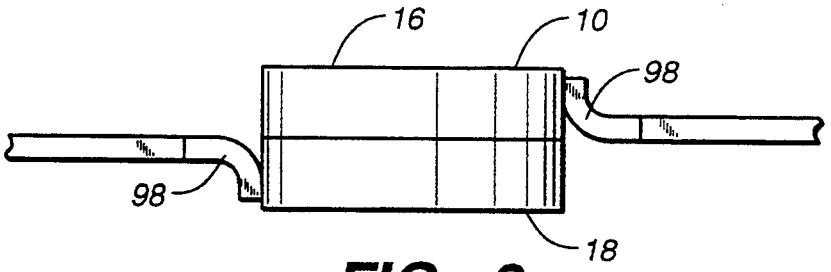
FIGS. 8 a detail elevational view of tabs on the nail clippings catcher which engage the nail clipper's jaws adjacent to their juncture for preventing rotation of the nail clippings catcher about the nail clipper's rivet.

As illustrated in FIGS. 2, 4, 6 and 7, the sheet 52 included pre-cut slits 98 formed through the sheet 52 immediately adjacent to the tabs 88. After the tabs 88 are disposed between the jaws 16 and 18, as illustrated in FIG. 8 the material of the sheet 52 is bent upward and/or downward to engage side surfaces of the jaws 16 and 18 immediately adjacent to where the jaws 16 and 18 join together. Engagement of the material of the sheet 52 with side surfaces of the jaws 16 and 18 at the slits 98 and the juncture of the jaws 16 and 18 prevents rotation of the nail clippings catcher 12 about the rivet 32 of the nail clipper 10.

As illustrated in FIGS. 2, 4 and 6; both of the star shaped apertures 56 and 76 formed respectively through the sheet 52 and the disk 74 include V-shaped notches 102 formed symmetrically on both sides of the fold-line 54 in FIG. 2. To adapt the nail clippings catcher 12 for use with various different sizes of nail clippers 10, the width of the apertures 56 and 76 as measured along the fold-line 54 must be wide enough to fit around the rivet 32 of the largest size of nail clipper 10. When the nail clippings catcher 12 is installed in the nail clipper 10 with the tabs 88 properly trimmed to fit that particular size of nail clipper 10, the V-shaped notches 102 bear against the rivet 32 thereby centering the nail clippings catcher 12 side-to-side within the nail clipper 10 regardless of the size of the rivet 32 included in the nail clipper 10.

Although the present invention has been described in terms of the presently preferred embodiment, it is to be understood that such disclosure is purely illustrative and is not to be interpreted as limiting. For example, the sheet 52 may be pre-cut into various different shapes which upon folding to form the nail clippings catcher 12 resemble something other than a butterfly. Similarly, a surface of the sheet 52 that becomes juxtaposed with itself by folding along the fold-line 54 may be fastened to itself in various different ways other than by the adhesive layer 68. For example the surface of a suitable sheet material may be bonded together by ultrasonic or thermo-compression bonding. While the preferred embodiment of the nail clippings catcher 12 is adapted for insertion into and removal from the open space 14 between the jaws 16 and 18 without removing the rivet 32 from the jaws 16 and 18, it is readily apparent that a nail clippings catcher 12 in accordance with the present invention may be inserted into or removed from the open space 14 by first removing the rivet 32 from the jaws 16 and 18 prior to insertion or removal of the nail clippings catcher 12 and then reinserting the rivet 32 through the jaws 16 and 18 after the nail clippings catcher 12 has been inserted into or removed from the open space 14. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A nail clippings catcher for use with a nail clipper of a type in which a pair of similarly-shaped elongated upper and lower jaws have first ends that are joined to each other, the jaws diverging away from each other along the length of the jaws extending away from the first ends thereby establishing an open space between the jaws, each of the jaws including matable, opposed cutting edges formed at ends of the jaws furthest from the first ends, the nail clipper further including a rivet having a longitudinal axis that extends through apertures respectively piercing each of the jaws adjacent to the cutting edges, said nail clippings catcher comprising:

a pre-cut sheet of material having both edges and a fold-line which passes through an aperture formed through said sheet, said sheet being adapted for being folded along the fold-line so a surface of said sheet becomes juxtaposed with itself and the sheet thus becomes fastenable to itself to establish a pocket within the folded sheet for catching nail clippings within the folded sheet, the pocket thus formed being open at the aperture formed through said sheet, the folded sheet being thereby adapted for insertion between the jaws of the nail clipper with the fold-line disposed adjacent to the cutting edges of the jaws, the folded sheet of material extending away from the fold-line and the cutting edges between the jaws toward the first ends of the jaws at which the jaws join together, and the aperture formed through said sheet providing a channel through the folded sheet for the rivet of the nail clipper; and a stiffener secured to a surface of the sheet about the aperture formed through the sheet.

2. The nail clippings catcher of claim 1 wherein said sheet of material is pre-cut symmetrically with respect to the fold-line so edges of said sheet juxtapose with each other upon folding said sheet along the fold-line.

3. The nail clippings catcher of claim 1 wherein the folded sheet of material extending away from the rivet of the nail clipper toward the first ends of the jaws at which the jaws join together may be trimmed to one of various different lengths whereby the nail clippings catcher may be readily adapted for use with one of various different sizes of nail clippers.

4. The nail clippings catcher of claim 1 wherein the folded sheet of material extends outward from both sides of the open space between the jaws of the nail clipper along the fold-line of said sheet thereby providing a surface which may be decorated and/or have a message fixed thereon.

5. The nail clippings catcher of claim 1 wherein said sheet of material is pre-cut so that after folding said sheet, the edges of said sheet do not extend beyond a circular arc lying in a plane that includes the fold-line, the circular arc also being centered about a point that is located within the aperture formed through the sheet; the circular arc extending through an angle of no more than sixty (60) degrees to one side of a reference line that is disposed normal to the fold-line; the reference line lying in the same plane as the fold-line and the circular arc, passing through the point about which the circular arc is centered, and extending from the aperture toward the edges of the sheet furthest from the aperture; whereby the nail clippings catcher may be inserted into or removed from the open space between the jaws of the nail clipper without loosening the rivet from the jaws.

6. The nail clippings catcher of claim 1 further comprising a nail clipper, said nail clipper receiving said nail clippings catcher between a pair of similarly-shaped elongated upper and lower jaws of the nail clipper, said jaws having first ends that are joined to each other, the jaws diverging away from each other along the length of the jaws extending away from the first ends, each of the jaws including matable, opposed cutting edges formed at ends of the jaws furthest from the first ends, the fold-line of said nail clippings catcher received within said nail clipper being disposed adjacent to the cutting edges of the jaws, the folded sheet of material of the nail clippings catcher extending away from the fold-line and the cutting edges between the jaws toward the first ends of the jaws at which the jaws join together.

7. A method for assembling a nail clippings catcher together with a nail clipper of a type in which a pair of similarly-shaped elongated upper and lower jaws have first ends that are joined to each other, the jaws diverging away from each other along the length of the jaws extending away from the first ends thereby establishing an open space between the jaws, each of the jaws including matable, opposed cutting edges formed at ends of the jaws furthest from the first ends, the nail clipper further including a rivet having a longitudinal axis that extends through apertures respectively piercing each of the jaws adjacent to the cutting edges, the method for assembling the nail clippings catcher comprising the steps of:

a. preparing a sheet of material for forming into a nail clippings catcher by punching an aperture through the sheet;

b. folding the punched sheet of material along a fold-line which passes through the aperture until a surface of the sheet become juxtaposed with itself;

c. fastening the juxtaposed surface of the sheet together while concurrently establishing a pocket within the folded sheet for receiving nail clippings; and d. inserting the folded and fastened sheet of material between the jaws of a nail clipper so the fold-line is disposed adjacent to the cutting edges of the jaws with the folded sheet of material extending away from the fold-line and the cutting edges toward the first ends of the jaws at which the jaws join together, and so the aperture formed through the sheet provides a channel through the folded sheet for the rivet of the nail clipper.

8. The method for assembling a nail clippings catcher of claim 7 further comprising the step of securing a stiffener to a surface of the sheet about the aperture formed through the sheet.

9. The method for assembling a nail clippings catcher of claim 8 wherein the stiffener is secured to a surface of the sheet before folding the sheet along the fold-line.

10. The method for assembling a nail clippings catcher of claim 7 wherein:

a. the rivet is removed from the nail clipper prior to inserting the folded and fastened sheet of material between the jaws; and b. the rivet is reinserted through both jaws of the nail clipper after the folded and fastened sheet of material has been inserted between the jaws.

11. The method for assembling a nail clippings catcher of claim 7 wherein the folded and fastened sheet is inserted between the jaws by:

a. sliding the jaws of the nail clipper onto the folded and fastened sheet of material at an oblique angle until the aperture formed through the sheet engages the rivet of the nail clipper; and b. rotating the folded and fastened sheet of material about the rivet of the nail clipper until the fold-line is disposed symmetrically with respect to the cutting edges of the jaws.

12. The method for assembling a nail clippings catcher of claim 7 further comprising the step of trimming to a particular length the folded sheet of material that extends away from the fold-line and the cutting edges toward the first ends of the jaws at which the jaws join together thereby adapting the nail clippings catcher for use with a particular size of nail clipper.

13. The method for assembling a nail clippings catcher of claim 7 further comprising the step of fixing a decoration on the sheet of material.

14. The method for assembling a nail clippings catcher of claim 7 further comprising the step of fixing a message on the sheet of material.

* * * * *